US005776212A

United States Patent [19]

Leas

[11] Patent Number: 5,776,212

[45] Date of Patent: Jul. 7, 1998

[54] CATALYTIC GASIFICATION SYSTEM

[76] Inventor: Arnold M. Leas, 122 N. 34th St., 10-C, Richmond, Ind. 47374

[21] Appl. No.: 716,716

[22] Filed: Sep. 13, 1996

Related U.S. Application Data

[62] Division of Ser. No. 352,833, Dec. 2, 1994, Pat. No. 5,641,327.

[51] Int. Cl.[6] ..... C10J 3/20; C10J 3/68; B01J 8/04

[52] U.S. Cl. ..... 48/73; 48/77; 48/63; 48/99; 48/189.1; 422/191; 422/192; 422/193

[58] Field of Search ..... 48/73, 77, 63, 48/99, 189.1, 198.2, 198.3, 202, 203, 210; 422/191, 193, 192

[56] References Cited

U.S. PATENT DOCUMENTS

| | | | |
|---|---|---|---|
| 2,607,666 | 8/1952 | Martin | 48/62 R |
| 3,322,521 | 5/1967 | Cockerham | 48/63 |
| 3,840,354 | 10/1974 | Donath | 48/202 |
| 3,847,563 | 11/1974 | Archer et al. | 48/77 |
| 3,864,100 | 2/1975 | Blaskowski | 48/73 |
| 4,118,204 | 10/1978 | Eakman et al. | 48/197 R |
| 4,303,415 | 12/1981 | Summers | 48/202 |
| 4,331,529 | 5/1982 | Lambert et al. | 208/410 |
| 4,348,487 | 9/1982 | Goldstein et al. | 518/704 |
| 4,410,420 | 10/1983 | Liss et al. | 208/127 |
| 4,432,773 | 2/1984 | Euker, Jr. et al. | 48/197 R |
| 4,617,027 | 10/1986 | Lang | 48/210 |
| 4,682,986 | 7/1987 | Lee et al. | 48/210 |
| 4,720,289 | 1/1988 | Vaugh et al. | 48/197 R |
| 4,799,937 | 1/1989 | Nieminen | 48/62 R |
| 4,917,024 | 4/1990 | Marten et al. | 110/233 |
| 4,927,430 | 5/1990 | Calderon | 48/197 R |
| 4,936,874 | 6/1990 | Eriksson et al. | 48/203 |
| 5,346,515 | 9/1994 | Kubiak et al. | 48/78 |

*Primary Examiner*—Nina Bhat
*Attorney, Agent, or Firm*—Bradford E. Kile; Karan Singh

[57] ABSTRACT

A catalytic gasification system for producing medium grade BTU gas including a gasification reactor having an inner air gasification zone, an outer steam gasification zone, a synthetic coal reaction zone, and an upper lime treating zone. The system of the present invention further includes a synthetic coal heating vessel which provides superheated recycled synthetic coal to the gasification reactor and a limestone treating vessel which provides superheated air and $CO_2$ to the gasification reactor. The system of the present invention provides for the production of a medium grade BTU gas and several commercially valuable by-products with virtually no solid or liquid waste products.

20 Claims, 2 Drawing Sheets

CATALYTIC GASIFICATION SYSTEM

This application is a division of U.S. application Ser. No. 08/352,833 filed Dec. 2, 1994 entitled "CATALYTIC GASIFICATION PROCESS AND SYSTEM FOR PRODUCING MEDIUM GRADE BTU GAS" now U.S. Pat. No. 5,641,327.

BACKGROUND OF THE INVENTION

The present invention relates to an improved process and apparatus for producing a useful gas from solid fuels. Specifically, the invention relates to a novel process and apparatus for producing a medium BTU clean gas from a solid fuel, such as coal, without manufactured oxygen. Moreover, the process and apparatus provides for the production of other products having direct commercial utility with virtually no solid or liquid waste.

Coal is the world's most abundant fuel resource. However, coal has limited commercial applications as an energy source due to its many practical limitations such as difficulties of transport and incompatibility with power generating devices.

Coal gasification processes have been developed which attempt to transform the coal from a carbonaceous solid fuel to a gas fuel which has much more practical utility. Such a system, for example, was disclosed in my U.S. Pat. No. 4,555,249 for "Process for Gasification of Coal and Organic Solid Wastes" and U.S. Pat. No. 4,274,839 for "Process for Gasification of Coal and Organic Wastes" which are hereby incorporated-by-reference. Generally, gasification processes provide a means for converting combustible organic materials such as coal, wood, tar sand, shale oil, and municipal, agriculture or industrial waste into a gas end product typically consisting of hydrogen or methane gas. The gas end product is then commonly utilized in a downstream phase of the process. For example, the gas product may be used to produce steam for the production of electricity or heating by passing the hot gases through a steam generation zone. Moreover, the production gases are often utilized in a downstream chemical process for further production. If the gas which is produced is a high grade gaseous stream it may be recovered for direct commercial use as a fuel energy source.

In order to produce a gaseous end product which has direct commercial utility—for example to drive a gas turbine or as a clean compression fuel source for use in an automobile engine—the gas end product must have a useful BTU level or grade. In this, a clean high BTU grade gas (viz. approximately 300 BTU/C.F.) is most preferable. However, a clean medium BTU grade (viz. approximately 200–275 BTU/C.F.) gas is also sufficient as a energy source for direct commercial uses. Significantly, however, a low BTU gas (viz. approximately 125–175 BTU/C.F.) is not a useful gaseous product in direct commercial applications. Moreover, a gas product of any grade is not acceptable if it contains contaminates which adversely affect its combustion properties. For example, a gas end product which contains large amounts of carbon dioxide, nitrogen, and sulfur compounds such as hydrogen sulfide ("sulfur gas") can not be used as a direct energy source for commercial applications. A gas end product having large amounts of contaminates is not acceptable in direct commercial applications, for example in gas turbines, because it will produce flame-out and stoppage. Moreover, the combustion by-products of a contaminated gas will produce environmentally unsafe by-products (e.g. $SO_x$ gas, $NO_x$ gas, particulate, etc.) which are unacceptable in commercial applications.

Common to all gasification techniques is the need for in process oxygen to carry out the necessary reactions (viz. to react with the carbon of the carbonaceous solid fuel). As a general matter, if the source of in-process oxygen for the gasification process is derived from manufactured oxygen, then the gaseous end product will be a high grade BTU gas. Conversely, if the source of in-process oxygen for the gasification process is derived from air or steam, then the gaseous end product will be a low grade BTU gas. For example, certain gasification processes currently employed by Texaco, Dow, and Shell require a high amount of in-process oxygen in order to produce a useful BTU gas end product. Although the gas end products of the Texaco, Dow, and Shell processes are high grade BTU gases (viz. approximately 300 BTU/C.F.), the processes require the use of manufactured oxygen. The gasification process currently employed by British Gas uses air and steam as a source of in-process oxygen, but the gas end product is a low grade BTU gas having limited commercial utility. The problem with utilizing manufactured oxygen as the source of in-process oxygen is that it has a commercially prohibitive cost. Manufactured oxygen can be one of the most significant costs in a gasification process. Manufactured oxygen is typically produced through a cryogenic method wherein a volume of air is reduced to extremely low temperatures—in the order of 360° F. below zero—whereby the $O_2$ is liquidized and removed in a pure liquid form. Current market rates for manufactured oxygen are approximately from five times the cost of on-site coal. Moreover, an oxygen gasification process requires about one ton of oxygen for every ton of coal. Accordingly, the high cost of manufactured oxygen adversely affects the economic efficiency of a gasification process. A common denominator of all gasification systems is that they must be economical to operate. Gasification systems have large initial capital investment cost and as a result, a low process efficiency is unacceptable to gasification management teams. In this, coal deposit owners are discouraged form using gasification techniques which are capable of producing a high BTU gas for direct commercial applications—for example to drive a gas turbine or as a clean compression fuel source for use in an automobile engine—which prevents the expansion of use of clean energy sources by the public. For example, a ready and cost effective source of compressed hydrogen would encourage automobile manufacturers to develop some hydrogen fueled automobiles. As noted, in order to effectively operate gas turbines, a medium to high grade BTU gas is required. Electrical power producers are discouraged by the high cost of coal gasification and have in the past almost exclusively utilized natural gas sources.

Manufactured oxygen has been the preferable source of process oxygen because it not only provides the necessary reaction content for the creation of a high grade BTU gas, but an excess amount of non-reacted $O_2$ is burned in order to create additional and necessary process heat. In order to eliminate the need for manufactured oxygen attempts have been made to use a process catalyst which accelerates the process reactions in order to provide beneficial temperature affects. One such attempt has been made by Exxon Research and Engineering Co. wherein the process reactions are carried out in the presence of a carbon-alkali metal catalyst. However, this Exxon gasification process and reaction catalyst have proven ineffective and problematic. The carbon-alkali metal catalyst of the prior art consist of an alkali metal (e.g. Na) with impregnated carbon. The alkali and carbon, however, are not chemically bonded, but merely coexist in their respective forms. Typically, the catalyst, in liquid form, is sprayed onto a fine coal and delivered to a reaction vessel. The inherent problem with the prior art catalyst is that once the gasification reactions are complete, the catalyst must be separated from the reaction products, such as coal ash, for disposal and/or recycling. This separation step involves the use of complex reactor designs and additional hardware which not only increase the complexity of the system, but increase capital cost significantly. As such, the prior art gasification systems which utilize reaction catalysts have proven to be commercially unacceptable. The prior art gasification systems have failed to provide a recycle reagent which serve as a process catalyst while providing superior recycling and density properties.

Prior art gasification methods and systems have proven disadvantageous for several other significant reasons. First, the prior art thermal gasification systems and methods require very high operating temperatures—approximately 2500° to 2800° F.—in order for the process reactions to occur. At these extreme operating temperatures, the iron based reaction vessels will melt if cooling mechanisms are not in place. Typically, such mechanism include complex and expensive vessel insulation schemes and/or heat exchanger cooling. Moreover, the high reaction temperatures require the use of expensive iron alloys—such as 310 (Cr/Ni) S.S. as fabrication material for the reaction vessels.

The prior art methods and systems have relatively low thermal process efficiencies. The prior art methods and systems have been unable to maximize the extent of gasification which occurs during the process thereby obtaining relatively low conversion efficiencies. The prior art methods and systems produce environmentally unsafe by-product waste which requires costly post process handling. The prior art techniques have been unable to produce commercially useful by-products from the gasification process. The prior art gasification methods and systems require the manufacturing of special process modules and hardware which increase production cost and make it more difficult to relocate from one mine site to another as resources change. The prior art systems which utilize manufactured oxygen in the production of high grade BTU gas, produce a product gas having very high exit temperatures which can not be directly used in gas turbines.

The difficulties and limitations suggested in the preceding are not intended to be exhaustive, but rather are among many which demonstrate that although significant attention has been devoted to solid gasification methods and systems, such methods and systems appearing in the past will admit to worthwhile improvement.

OBJECTS AND BRIEF SUMMARY OF THE INVENTION

It is therefore a general object of the invention to provide a novel solid gasification process and system which will obviate or minimize difficulties of the type previously described.

It is another general object of the invention to provide a novel solid gasification process and system which provides for the production of a medium grade BTU gas (e.g. approximately 225 BTU/C.F.) without manufactured oxygen.

It is another general object of the invention to provide a novel solid gasification process and system which provides for the production of a gas end product having direct commercial use—for example to drive a gas turbine or as a clean compression fuel source for use in an automobile engine—without the need for further downstream processing.

It is a specific object of the invention to provide a solid gasification process and system which utilizes a catalytic process reagent which optimizes process parameters.

It is another specific object of the invention to provide a solid gasification process and system which utilizes a catalytic reagent which does not require post reaction separation steps.

It is yet another specific object of the invention to provide a solid gasification process and system which utilizes a catalytic process reagent having optimal density and recycling characteristics.

It is still another specific object of the invention to provide a solid gasification process and system which operates under substantially reduced reaction temperatures.

It is yet another specific object of the invention to provide a solid gasification process and system which substantially increases the solid-gas conversion efficiency over prior art systems.

It is another specific object of the invention to provide a solid gasification process and system which substantially decreases production cost over prior art systems.

It is yet another specific object of the invention to provide a solid gasification process and system which provides for the production of useful and commercially viable by-products.

It is still another specific object of the invention to provide a solid gasification process and system which eliminates and/or significantly reduces the formation of environmentally harmful by-products.

It is yet another specific object of the invention to provide a solid gasification process and system wherein the primary reactions are contained within a single reaction containment vessel thereby optimizing reaction heat transfer and reducing production cost.

It is still yet another specific object of the invention to provide a solid gasification process and system which utilizes standard petroleum refinery process hardware thereby removing the need for specialized component manufacturing.

It is still yet another specific object of the invention to provide a solid gasification process and system which is designed such that removal of useful reaction products is easily accomplished without the need for special separating devices.

It is still yet another specific object of the invention to provide a solid gasification process and system which includes further downstream operations to produce additional products having direct commercial utility.

BRIEF SUMMARY OF A PREFERRED EMBODIMENT OF THE INVENTION

A preferred embodiment of the invention which is intended to accomplish at least some of the foregoing objects comprises catalytic gasification process and system for producing medium grade BTU gas including a gasification reactor having an inner air gasification zone, an outer steam gasification zone, a synthetic coal reaction zone, and an upper lime treating zone. The novel process and system of the present invention utilizes a catalytic reagent that serves to optimize reaction parameters and process flow and which does not require post reaction separation steps. The novel process and system of the present invention provides for the production of a medium grade BTU gas and several commercially valuable by-products with virtually no solid or liquid waste products.

DRAWINGS

Other objects and advantages of the present invention will become apparent from the following detailed description of a preferred embodiment thereof taken in conjunction with the accompanying drawings, wherein.

DETAILED DESCRIPTION

Figure 1:
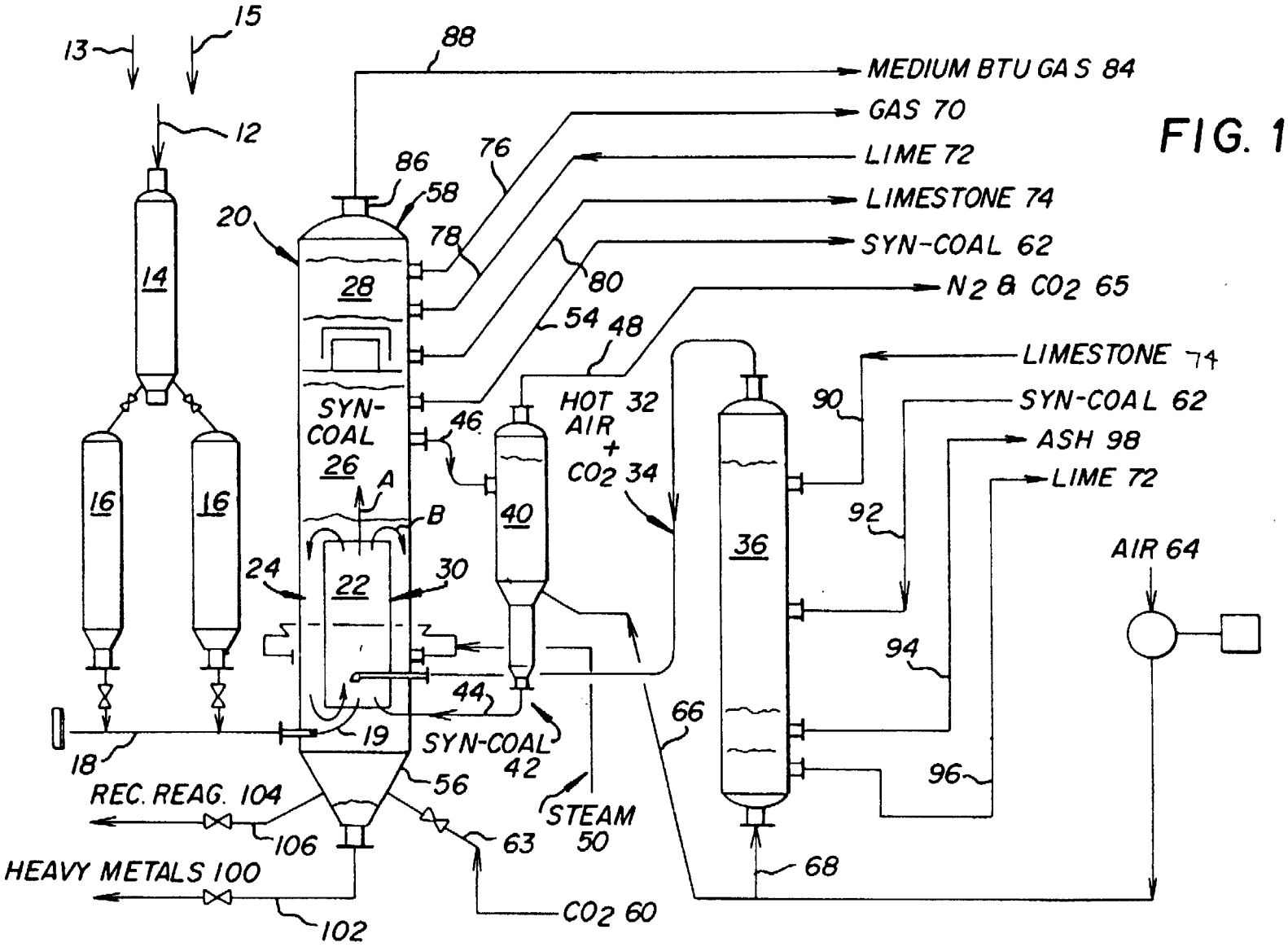
FIG. 1 is a schematic drawing of primary components of the solid gasification process and system of the present invention.

Referring now to the drawings and particularly to FIGS. 1, there is shown primary components of the solid gasification system 10 of the present invention. As shown, the process reactants 12 are conveyed into the elevated surge hopper 14. In the preferred embodiment, the combined process reactants 12 consist primarily of fine coal 13 and a process recycle reagent 15. The blended process reactants 12 have been previously treated in an upstream treatment process not depicted in the drawings. Specifically, raw coal is first delivered from a coal mine and conveyed into a hopper where it is pulverized to form a fine coal product which includes coal ash. The fine coal product is then conveyed from the hopper into a blender where it is mixed with a recycle reagent. The blended fine coal and recycle reagent is delivered as the process reactants 12 to the surge hopper 14 as shown in FIG. 1. The process reactant 12 are then delivered to at least one, but preferably two, lock bins 16. The lock bins 16 serve as a holding vessel for the reactants 12 and assure that a ready supply of reactants 12 is always available for delivery to the gasification vessel 20. Preferably, lock bins 16 are air pressurized vessels which assures sufficient flow of the reactants 12 into the screw drive assembly 18. Vessel pressure is preferably in the order of 180 p.s.i.g. which assures that the reactants 12 are driven upstream. The surge hopper 14 is located in a position vertically above the lock bins 16 in order to assist in the flow of the reactants 12 as attributed by gravity. The process reactants 12 are delivered from the lock bins 16 into the variable screw drive apparatus 18 which conveys the reactants upon controlled demand into the bottom of the gasification vessel 20. Other conveying devices are considered to be within the scope of the invention.

The gasification vessel 20 is a single shell design and provides significant advantage over prior art vessels. The gasification vessel 20 is designed to contain four process reaction zones 22, 24, 26, and 28 which operate in a related and synergistic fashion to provide the improved and novel results of the present invention. The first inner process reaction zone 22 is located in a beta-leg of the gasification vessel 20. The second outer process reaction zone 24 is located in a gamma-leg of the gasification vessel 20. The third reaction zone 26 is a deep fluidized bed of synthetic coal ("syn-coal") floating on top of an internal recycle reagent 15 as more completely described below. A fourth reaction zone 28 is located in an compartment adjoining the third reaction zone 26.

The beta-leg of the gasification vessel 20 is defined by an annular sleeve 30 preferably manufactured from stainless steel. The annular sleeve 30 separates the first inner reaction zone 22 and the second outer reaction zone 24. The process reactants 12, consisting of blended pulverized coal 13 and recycle reagent 15, are delivered into the bottom of the beta-leg 22 via line 19 as shown in FIG. 1. The beta-leg 22 is further supplied with hot air 32 and hot $CO_2$ 34 delivered from the limestone calcinator 36 via line 38 as more fully described below. Heated recycled synthetic coal 42 is delivered from heating vessel 40, via line 44, to the beta-leg which houses the inner reaction zone 22. The primary reaction which occurs in the first inner reaction zone 22 is air gasification of the fine coal 13 which occur as follows:

$$2\ C+AIR\ (O_2)\rightarrow 2\ CO+N_2+HEAT \quad (1)$$

The hot air 32 and hot $CO_2$ 34 is supplied from the limestone calcinator 36 under pressure, preferably in the order of 180 p.s.i., which is directed at the fine coal 13. In this, the carbon is oxidized and uniformly redeposited onto the recycle reagent 15, the clean coal ash, and the recycle syn-coal 42 as the superheated air 32 strikes the incoming dried pulverized coal 13, recycle reagent 15, and recycled syn-coal 42. As indicated, the reaction (1) occurring in the first inner reaction zone 22 is an exothermic reaction which provides the reaction heat necessary for the endothermic chemical reaction (2) occurring in the second outer reaction zone 24. The inner reaction zone forms a fluidized bed of solid and gas moving upward. The superheated air 32 causes the carbon from the pulverized coal 13 to be redeposited on the recycled syn-coal 42 which flows upward into the syn-coal fluidized bed 26 as indicated by arrow A. The superheated air 32 also causes the carbon from the pulverized coal 13 to be deposited on the coal ash, a product of pulverized coal 13, thereby forming syn-coal which travels upward and into the fluidized bed 26 in the same manner as the recycled syn-coal 42. The superheated air further causes the carbon from the pulverized coal 13 to be deposited on the fluidized recycle reagent which flows upward in the direction of arrow A, but due to its higher density, overflows into the outer reaction zone 24. In this, the recycle reagent circulates between the inner reaction zone 22 and the outer reaction zone 24 as indicated by arrows B. The superheated air gasification identified by reaction (1) produces a low grade BTU gas in the order of 120–150 BTU/C.F.

The gamma-leg 24 of the gasification 20 is also defined by the cylindrical stainless steel skirt 30 and consist of an outer annular reaction zone. Super heated steam 50 is delivered via line 52 from a steam generation plant (not shown). The gamma-leg 24 is further supplied with heated recycle reagent having carbon deposited thereon which emerges from the inner reaction zone as indicated by arrows B. The heated recycle reagent having deposited carbon operates in a percolation downward flow through the outer reaction zone 24 at a relatively reduced velocity as compared with the inner reaction zone 22. The gases produced in the outer reaction zone, however, flow upward into the third reaction zone 26. The primary chemical reaction occurring in the outer reaction zone 24 is steam gasification defined as follows:

$$C+H_2O+HEAT\rightarrow H_2+CO \quad (2)$$

The endothermic reaction (2) occurring in the outer reaction zone 24 produces a high grade BTU gas in the order of 300–325 BTU/C.F.

The novel gasification process and system of the present invention includes the coordinated interaction between the inner and outer reaction zones which provides advantageous process result. Specifically, in the inner reaction zone the upward fluidized bed uses air to oxidize carbon, redeposit carbon on the clean coal ash (thereby forming synthetic coal) and recycled synthetic coal 42, produce a low grade BTU gas, and to provide exothermic heat in accordance with reaction (1). In the outer zone 24 the downward percolation flowing bed uses steam under endothermic heat to produce a high grade BTU gas in accordance with reaction (2). The process recycle reagent 15 serves an important function in this regard. Specifically, the proper recycle reagent must be selected which allows for circulation through both the inner and outer reaction zone in order to balance the exothermic heat of the inner reaction (1) and the endothermic heat of the outer reaction (2). Moreover, the recycle reagent must be capable of being deposited with carbon originating from the coal. In this, the carbonated recycle reagent flowing from the inner reaction zone 22 as indicated by arrow B carries the carbon necessary for reaction into the outer reaction zone 24. The recycle reagent should have an intermediate density which is greater than that of synthetic coal in order to allow for the formation of the floating synthetic coal bed 26 on the one hand, and light enough to allow for fluidization on the other hand. The preferred process reagent of the present invention is sillimanite $Al_2O_3.SiO_2$. Sillimanite has a density in the order of 50 lbs/c.f. The sillimanite is injected and chemically combined with a catalytic agent in order to produce a catalytic process reagent. Various catalytic agents may be used such as sodium to yield $Al_2O_3.SiO_2.Na_2O$ or potassium to yield $Al_2O_3.SiO_2.K_2O$. However, the concentration of the alkaline injection is small in order to retain the primary reagent as $Al_2O_3.SiO_2$. Test have shown that the optimal weight percent for the process reagent is in the order of 75% reagent and 25% catalytic agent. Another acceptable recycle reagent is mullite $3Al_2O_32.SiO_2$. Mullite has a density in the order of 54 lbs/c.f. Again, pulverized mullite is treated with sodium or potassium in order to provide a catalytic reagent. Attapulgas clay can also be used as a recycle reagent with, however, increased yield in ash by-product. Other recycle reagents having properties described above are considered to be within the scope of the invention.

The recycle reagent of the present invention maintains a clean gasification reactor and facilitates the fractionation and withdrawal of several relatively pure solid valuable by-products. The catalytic recycle reagent of the present invention is a significant improvement over prior art catalytic reagents because it consists of a base material (e.g. sillimanite) having advantageous density and recycle characteristics and which chemically combines with a catalytic agent. No post reaction separation is required. In fact, the novel process and system of the present invention permits the catalytic reagent to self recycle in flowing from the first to second reactions zones due to the differential densities of the system products. In the prior art catalytic gasification processes, complex and cost prohibitive system components are necessary in order to separate the catalytic reagent from the coal ash for recycling or disposal.

The third reaction zone 26 is defined by the fluidized bed of synthetic coal. As previously noted, the fluidized bed of syn-coal is continuously stocked with re-carbonated recycled syn-coal 42 and with carbonated clean ash (i.e. syn-coal which has not yet been recycled). The fluidized bed of syn-coal floats on top of the moving recycle reagent 15 of the inner 22 and outer 24 reaction zones. Specifically, the recycle reagent has a density which is greater than that of syn-coal thereby causing the syn-coal to move upward and float on top of the recycle reagent. Syn-coal typically has a density in the order of 35 lbs/c.f. As shown in FIG. 1, a portion of the syn-coal is removed from the fluidized bed through line 46 and delivered to heating vessel 40 as more completely described below. Another portion of the syn-coal is removed from the fluidized bed through line 54 and delivered to a syn-coal conglomeration unit 108 as more completely described below with reference to FIG. 2.

The syn-coal withdrawal rates through lines 46 and 54 are controlled so as to maintain a constant deep syn-coal bed which provides for reaction zone 26. The syn-coal bed 26 is provided, in part, as a secondary reaction zone in order to react excess carbon deposited on the syn-coal with $C0_2$ gas flowing upward from the first inner reaction zone 22. The primary reaction in the syn-coal fluidized bed occurs as follows:

$$CO_2+C+HEAT \rightarrow 2\ CO \quad (3)$$

The source of the $CO_2$ which drives reaction (3) is from the inner reaction zone 22. The $CO_2$ which rises out of the inner reaction zone 22 is derived from several sources. First, as noted, hot air 32 and $CO_2$ gas 34 is delivered into the inner reaction zone 22 from lime stone calcinator 36 via line 38. Second, in order to provide additional exothermic heat in the inner reaction zone 22, the carbon deposited on recycled syn-coal 42 and on the formed syn-coal is air oxidized to primarily produce $C_2$. Moreover, $CO_2$ 60 is injected at the bottom 56 of the gasification vessel 20 through supply line 63 in order to establish adequate sealing between the inner 22 and outer 24 reaction zones. The unreacted $CO_2$ from these sources rises from the inner reaction zone 22 and into the third reaction zone 26 which is maintained directly above the inner 22 and outer 24 reaction zones.

The presence of a floating syn-coal fluidized bed 26 provides for advantageous results which contribute to the novel and superior process and system of the present invention. First, the unreacted carbon which has been deposited on the clean ash is reacted with $CO_2$ gas in accordance with reaction (3) to form additional high grade BTU gas (viz. approximately 300 BTU/C.F.). This is advantageous in that it increases overall system efficiency by maximizing the use of the carbonaceous fuel. Second, the controlled floating syn-coal fluidized bed allows for the withdrawal of a valuable by-product which may be put to direct use or subjected to further processing. For example, the withdrawn syn-coal 62 maybe delivered to a conglomeration unit 108 as more completely described below. Third, a portion a the syn-coal is withdrawn and delivered to a heating vessel 40 wherein the carbon of syn-coal is air oxidized and re-directed to the inner reaction zone 22 to provide additional process heat.

A portion of the syn-coal of the fluidized bed 26 is withdrawn through line 46 and delivered to reaction heating vessel 40. Compressed air 64 is delivered through line 66 into a lower portion of the vessel 40. The carbon of the syn-coal is reacted with the oxygen of the compressed air to provide the following exothermic reaction:

$$C+AIR\ (O_2) \rightarrow CO+N_2+HEAT \quad (4)$$

Reaction (4) produces a significant amount of process heat which is stored in the moving syn-coal mass and delivered, via line 44, into the inner reaction zone 22 as heated recycle syn-coal 42. The contaminate by-products of reaction (4) are typically $CO_2$ and $N_2$ 65. In utilizing a separate heating reaction vessel 40, the $CO_2$ and $N_2$ gases 65 may be easily retrieved from the top of the vessel 40 and delivered, via line 48, to a storage vessel or subjected to further processing. In this, a significant amount of process heat is created while avoiding the mixture of contaminate gas with useful grade BTU gas. Moreover, the heating vessel 40 provides for a significant amount of process operating flexibility. Specifically, the quantity and quality of the syn-coal recycled can be controlled and adjusted to accommodate the heat balance of the system. That is, if more exothermic heat is required in the inner reaction zone 22, an operator would increase the supply of heated recycle syn-coal 42.

The fourth upper reaction zone 28 serves as a hot lime treating section of the gasification vessel 20. The main purpose of the upper lime treating section 28 is to remove contaminate gas from the producer gas product. Specifically, the lime treating section 28 serves to eliminate the presence of $H_2S$ from the product gas under the following reaction:

$$H_2S+CaO \rightarrow CaS+H_2O \quad (5)$$

Hydrogen sulfide $H_2S$ gas is an undesirable sulfur by-product of coal gasification. Its presence in the product gas lowers BTU content and prevents direct commercial use. The upper lime treating zone 28 reacts the $H_2S$ with lime CaO (a carbonate of calcium) in order to create a manageable and easily removable solid by-product CaS 70. The upper lime treating zone 28 is contained in an upper section of the gasifier reaction vessel 20 and separated from the third reaction zone 26 by a connecting partition 82. Hydrogen sulfide $H_2S$ gas produced as a by-product in the inner reaction zone 22 travels into the lime treating zone 28 through partition 82. Lime 72 is delivered to the upper reaction zone 28 via supply line 78. The lime 72 is delivered from limestone calcinator 36 as a by-product of reaction (6). The lime 72 and $H_2S$ gas react in accordance with reaction (5) to produce CaS and $H_2O$. Significantly, the CaS 70 has a lower density (viz. in the order of 50 lbs./c.f.) than the lime 72 (viz. in the order of 80 lbs./c.f.) and, thus, floats on top of the lime 72. In this, the CaS 72 can be easily removed as a clean by-product from the upper reaction zone 28 through withdrawal line 76. Limestone $CaCO_3$ 74 is formed in a secondary reaction of the upper reaction zone. Again, the limestone 74 has a greater density (viz. in the order of 65 lbs./c.f.) than CaS 70 and, therefore, settles on the partition 82 for removal through line 80. The withdrawn limestone 74 is transported, via line 80, to the limestone calcinator 36 for further processing as fully set forth below. The lime treating zone 28 allows for the removal of the contaminate gas $H_2S$ as a clean by-product CaS. Moreover, secondary reactions occurring in the upper reaction zone 28 provide for the removal of contaminate $CO_2$ gas in order to increase BTU content of the product gas. The upper treating zone 28 is advantageous to the overall gasification process and system 10 in that it increases the quality of the final gas product and decreases the amount of waste by-products.

The novel process and system of the present invention allows for reduction of operating pressures and temperatures. In using the novel catalytic reagent and system arrangement of the present invention, the necessary process reactions (viz. air and steam gasification) occur at substantially lower temperatures and pressures over prior art thermal systems. Specifically, operating reaction temperatures are reduced in the order of 1000° F. below prior art thermal processes. In this, the need for complex insulation and cooling systems, expensive reaction vessels, and manufactured oxygen is eliminated. The operating parameters of the gasification reactor 20 include a vessel pressure in the order of 175 p.s.i.g. and a vessel temperature profile in the order of 850°–1650° F. The temperature of the hot air 32 and $CO_2$ gas 34 is in the order of 1650°–1700° F. Generally, the results of the process of the present invention can be achieved when the reaction vessel is maintained with a pressure in the range of 150 to 200 p.s.i.g. and a temperature profile in the range of 850°–1700° F. The temperature of the recycled syn-coal 42 delivered into the inner reaction zone is in the order of 1600°–1620° F. The $N_2$ and $CO_2$ vent gases 65 from the syn-coal heating vessel 40 are removed at a temperature in the order of 1800°–1810° F.

The product gas 84 is removed through a valve 86 located on the top of the gasifier vessel 20 and delivered, via line 88, to a storage vessel (not shown). Preferably, however, the product gas 84 is first injected through a standard commercial filter (not shown), such as a cyclone, for the removal of any unwanted solid impurities. Significantly, the product gas 84 is a medium grade BTU gas having direct commercial applicability. The product gas 84 is preferably a medium grade BTU gas having a content in the range of 200–250 BTU/C.F. The product gas 84 is derived from the mixing of the low grade BTU gas of the inner reaction zone 22 and the high grade BTU gas of the outer reaction zone 24. The BTU content of the product gas 84 will vary depending on the particular system inputs. The product gas 84 can be stored in transport vessels and transported for direct commercial use by a consumer. For example, the product gas 84 could be stored and delivered to a service station for use in automobiles having gas engines. Alternatively, the product gas 84 could be delivered directly on site to a gas turbine for the creation of electricity for delivery to the consuming public or use by manufacturing facilities. No additional costly and environmentally harmful treatment is required to be performed. Significantly, the source of in process oxygen for the process of the present invention originates from steam, $CO_2$, and air through carbon reactions. The product gas 84 of the present invention has direct commercial applications and is provided without the use of manufactured oxygen.

As previously discussed, hot air 32 and $CO_2$ 34 is delivered to the inner reaction zone 22 in order to drive reaction (1). The source of hot air 32 and $CO_2$ 34 is derived from the limestone calcinator vessel 36. The limestone calcinator vessel 36 is supplied with limestone 74 via supply line 90. The source of the limestone 74 is from make up and the upper lime treating zone 28 of the reactor vessel 20. The limestone 74 is transported, via line 80, to at least a pair of lock bins (not shown) from which supply line 90 delivers the limestone 74 into an upper portion of the reaction vessel 36. Similarly, a portion of the syn-coal 62 withdrawn from the syn-coal fluidized bed 26 of the gasifier reactor 20 is delivered, via line 54, to at least a pair of lock bins (not shown). The syn-coal is then withdrawn as needed from the lock bins and delivered, via supply line 92, to a mid-section of the reaction vessel 36 as shown in FIG. 1. Compressed air 64 is delivered, via supply line 68, to the bottom of the reaction vessel 36 as indicated in FIG. 1. The compressed air 64 is supplied from product gas 84 expanders (not shown) and a steam driven compressor (not shown) which may be designed to utilize system products depending upon client desires and the integration of outside plant facilities. The reaction vessel 36 contains the following primary reactions:

$$CaCO_3+HEAT \rightarrow CO_2+CaO \quad (6)$$

$$\text{SYN-COAL (C)+AIR (O2)} \rightarrow \text{HOT } CO_2\text{+EXCESS AIR} \quad (7)$$

The primary reaction (6) yields $CO_2$ gas and lime 72. Due to its density, the lime 72 settles on the bottom of the reaction vessel 36 as shown in FIG. 1. The lime 72 is then easily withdrawn from the vessel 36, via line 96, and delivered to a holding vessel (not shown) for temporary storage. From the holding vessel, the lime 72 is withdrawn, as necessary, and delivered, via line 78, to the lime treating zone 28 of the gasifier vessel 20. Reaction (7) produces the desired hot $CO_2$ gas and air which is captured at the top of the reaction vessel 36 and diverted, via line 38, to the inner reaction zone 22 of the gasifier 20. Coal ash 98 is an additional by-product of the reactions of the limestone calcinator vessel 36. Coal ash 98—having a density in the order of 40 lbs./c.f.—floats on top of the lime 72 in the vessel 36 and is withdrawn and delivered, via line 94, to a storage vessel (not shown). The coal ash 98 may then be delivered to the coal/reagent blending vessel (not shown) for recycling through the gasifier. The limestone calcinator provides for hot $CO_2$ gas and air ($O_2$) which are used in the gasification process. The novel system 10 is designed such that the limestone calcinator vessel 36 operably interacts with the gasifier vessel 20 to utilize the reaction by-products for the production of in process hot $CO_2$ gas and air ($O_2$).

The heavy metals 100 contained in the coal 13 settle at the bottom of the gasifier vessel 20 and are withdrawn and delivered, via line 102, to a storage vessel (not shown). The heavy metal inorganic by-products may then be safely and conveniently removed and delivered for sale or to a disposal site. The conversion of organic metals to inorganic metals facilitates the removal of coal metals 100. Furthermore, any remaining traces of coal metals are absorbed by the system reagent 15 and removed during reagent recycling. Any system reagent 15 which is not effectively delivered to the inner reaction zone 22, is withdrawn out of the bottom of the reaction vessel 20. The recycled reagent 104 is delivered, via line 106, to recycle reagent lock bin (not shown) where it may then be delivered to the coal/reagent blender (not shown) for reprocessing. The recycling of the reagent in this manner increases the over all efficiency of the gasification system 10.

Figure 2:
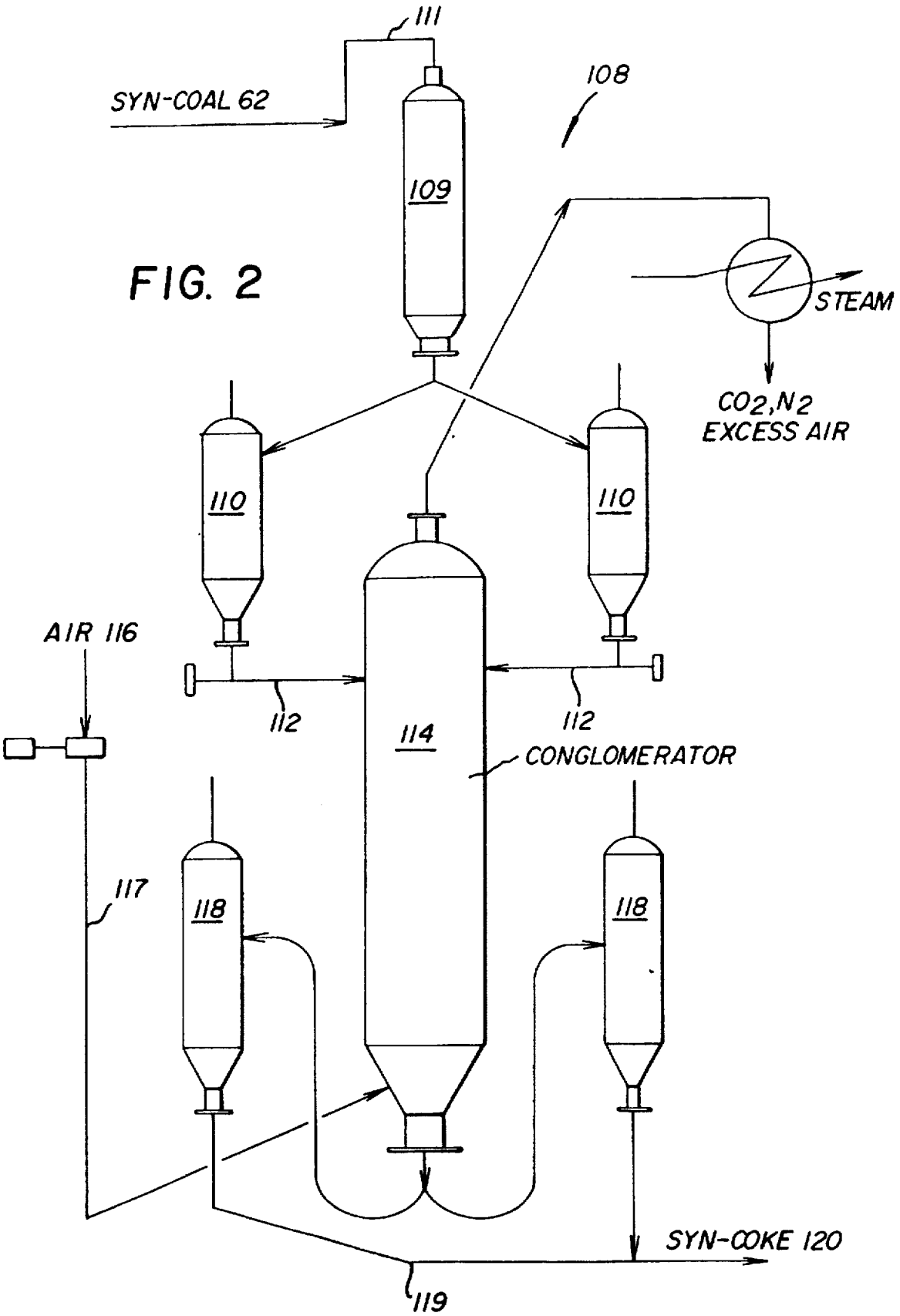
FIG. 2 is a schematic drawing of components of the synthetic coal conglomeration unit of the solid gasification process and system of the present invention.

Further economic improvement can be made by further downstream processing of the syn-coal 62 withdrawn from the fluidized bed 26 of the gasifier 20. Referring now to FIG. 2, there is shown a syn-coal conglomeration system 108. Simply, the system 108 processes the syn-coal 62 in order to form lump coke 120 having direct commercial utility. Generally, coke is a solid carbonaceous residue having no volatile material which is a common fuel source used in manufacturing steel. The lump coke of the present invention can replace metallurgical coke for burning in steel blast furnaces. The lump coke 120 of the present invention is produced at approximately one-half the production cost of metallurgical coke.

The syn-coal 62 which has been withdrawn from the fluidized bed 26 of the gasifier 20 is first delivered to a temporary storage vessel (not shown) from which a portion of the syn-coal is delivered to the limestone calcinator 36 as previously described with reference to FIG. 1. Most of the syn-coal 62, however, is withdrawn and delivered, via line 111, to hopper 109. The syn-coal 62 is then gravitated into at least a pair of lock-bins 110. Variable speed screw 112 drives force the powdered syn-coal 62 into a conglomerator reactor vessel 114. Compressed air 116 is additionally delivered, via line 117, to the conglomerator as a driving reactant. The air 116 then burns a sufficient amount of the carbon of the syn-coal 62 in order to melt a portion of the ash of the syn-coal 62 to conglomerate the syn-coal 62 into lump coke. The heavier lump coke then gravitates into the lock-bins 118. The lump coke 120 is then withdrawn and delivered, via line 119, to a storage facility for transport to a commercial site.

The novel process and system 10 of the present invention can be further described and demonstrated with reference to several developmental test runs which have produced the identified results.

| Example I | |
|---|---|
| System Input | |
| reagent catalyst: $Al_2O_3.SiO_2.Na_2O$ | |
| coal feed rate (12,000 BTU coal) | 5 TPD |
| recycle reagent withdrawn to blend | 1 TPD |
| Product Yields | |
| 225 BTU gas | 4.5 MMBTU/hr. |
| CaS | .38 TPD |
| heavy metal concentrate | .03 TPD |
| ash | .43 TPD |
| Operating Parameters | |
| gasifier pressure | 175 psig |
| gasifier temperature profile | 875–1650° F. |
| calciner air-$CO_2$ to gasifier | 1700° F. |
| syn-coal recycle to gasifier | 1650° F. |
| syn-coal external heater vent | 1800° F. |
| oxygen source | |
| from air | 34% |
| from steam | 28% |
| from $CO_2$ | 38% |

| Example II | |
|---|---|
| System Input | |
| reagent catalyst $Al_2O_3.SiO_2.Na_2O$ | |
| coal feed rate (12,000 BTU coal) | 10 TPD |
| recycle reagent withdrawn to blend | 2 TPD |
| Product yields | |
| 225 BTU gas | 4.5 MMBTU/hr. |
| syn-coal | 4.1 TPD |
| CaS | .75 TPD |
| heavy metal concentrate | .06 TPD |
| ash | .40 TPD |
| Operating Parameters | |
| gasifier pressure | 175 psig |
| temperature profile | 870–1700° F. |
| calciner air-$CO_2$ to gasifier | 1660° F. |
| syn-coal recycle to gasifier | 1620° F. |
| syn-coal external heater vent | 1810° F. |

Example III

System Input
same as Example I except Illinois coal containing organic chlorine was the feed stock
Product yields
same as Example I
Operating Parameters
same as Example I
Disposition of Chlorine 1. add sufficient $BaCO_3$ to Lime treating zone
2. during gasification and hot treating the following reaction occurs:
   $2\ HCl + BaCO_3 \rightarrow BaCl_2 + H_2O + CO_2$
3. add external cold air fluidized bed to separate out $BaCl_2$ from $CaCO_3$ and excess CaO
4. the specific gravity of elements is as follows:

| | |
|---|---|
| $BaCl_2$ | 3.856 |
| $BaCO_3$ | 4.43 |
| CaO excess | 3.346 |
| $CaCO_3$ | 2.93 or 2.71 |

5. the $BaCl_2$ and excess $BaCO_3$ have commercial value and can be utilized in chemical plant operations In order to determine the quality of the product syn-coal of the above developmental runs, several test were performed. A magnet test indicated that no heavy metals were present. A chemical test indicated that no sulfur, tar oils, water, or halogens were present in the product syn-coal. The production of a syn-coal by-product free of contaminates is a substantial improvement over prior art systems. The novel process and system of the present invention allows for the production of a valuable reaction by-product having direct commercial value.

The process and system 10 of the present invention provides for an economical way to produce a medium grade BTU gas product which has direct commercial utility. significantly, the process and system 10 of the present invention does not require the use of manufactured oxygen. The source of in-process oxygen is derived from steam, $CO_2$, and air through carbon reactions. In avoiding the requirement of manufactured oxygen, the process and system 10 of the present invention can produce medium BTU gas having direct commercial utility at substantially reduced cost. Moreover, in using the novel catalytic reagent of the present invention, the need for complex and cost prohibitive post reaction separation hardware is avoided. The novel process and system of the present invention thereby reduces capital cost to about one-third and product production cost to about one-half. In this, the process and system 10 of the present invention can be commercialized by a wide variety of electrical producers, manufacturing companies, coal deposit owners, and the like in order to produce medium grade BTU gas having direct commercial utility. The process and system 10 of the present invention provides for an economical way to produce medium BTU gas having direct commercial utility which, when commercialized, would provide an incentive for product manufacturers (e.g. automobile manufactures) to increase product production for products which operate from clean gas. The process and system 10 of the present invention provides for an economical way to utilize the world's most abundant fuel source (viz. coal) in order to produce medium BTU gas having direct commercial utility. The synergistic relationship between the four reaction zones allows for an increase in thermal efficiency over the prior art systems from approximately 72% (prior art systems) to 89%.

Moreover, the process and system 10 of the present invention provides an economical way to produce medium BTU gas having direct commercial utility with virtually no solid or liquid waste products. The process and system 10 of the present invention provides for maximum usage of the system by-products in order to create additional products having commercial value.

SUMMARY OF MAJOR ADVANTAGES OF THE INVENTION

After reading and understanding the foregoing detailed description of a catalytic gasification process and system for the production of medium grade BTU gas in accordance with preferred embodiments of the invention, it will be appreciated that several distinct advantages of the subject process and system for the production of medium grade BTU gas are obtained.

Without attempting to set forth all of the desirable features of the instant gasification process and system for the production of medium grade BTU gas, at least some of the major advantages include providing a gasification reactor vessel 20 having four reaction zones 22, 24, 26, and 28. In the first reaction zone 22, air gasification of the carbon of the fine coal 13 occurs yielding a low BTU gas in an upward fluidization mode. Moreover, the air jet 32 strikes the dried pulverized coal 13, reagent 15, and recycled syn-coal 42 to deposit the carbon from the coal onto the coal ash, catalytic reagent 15, and recycled syn-coal 42. In the second reaction zone 24, superheated steam gasification of the carbon deposited on the hot recycle reagent 15 occurs yielding high grade BTU gas (e.g. approximately 300 BTU/C.F.). The steam gasification occurs in a downward percolation mode for the solid particles and an upward flow for the product gas. The system reagent 15 is selected so as to provide circulation through both the inner and outer reaction zone in order to balance the exothermic heat of the inner reaction (1) and the endothermic heat of the outer reaction (2). Moreover, the catalytic recycle reagent should have an intermediate density which is greater than that of synthetic coal in order to allow for the formation of the floating synthetic coal bed 26. The reagent is selected to permit chemical bonding between the reagent and the catalytic agent. The preferred recycle reagent of the present invention is sillimanite $Al_2O_3.SiO_2$.

In the third reaction zone 26, the carbon of the syn-coal is reacted with residual $CO_2$ in order to increase the production of high grade BTU gas and produce additional endothermic reaction heat for heat recovery. This sequential cooling improves plant efficiency. A deep syn-coal fluidized bed is maintained which allows for withdrawal of syn-coal as a clean by-product for further downstream production in a syn-coal conglomeration unit 108. Moreover, syn-coal is withdrawn from the third reaction zone 26 for recycling back into the inner reaction zone 22. In the upper lime treating zone 28, contaminate $H_2S$ gas in converted into a useful and manageable by-product CaS 70 which may be easily removed from the system.

Gasification support reactor vessels include a recycle syn-coal heating vessel 40 and a limestone calcinator vessel 36. In the recycle syn-coal heating vessel 40, the syn-coal from reaction zone 26, withdrawn through line 46, is superheated through air burning of a portion of the carbon on the recycle syn-coal and reintroduced into the first reaction zone 22 thereby providing increased reaction heat. Moreover, contaminate reaction gases $N_2$ and $CO_2$ are easily and safely removed from the top of the reactor vessel 40 thereby avoiding contamination of the product gas 84. In the limestone calcinator vessel 36, the necessary process air 32 is superheated and delivered, via line 38, to the inner reaction zone 22. Compressed air 64 and syn-coal 62 is injected into the reaction vessel 36 to simultaneously calcine limestone whereby lime and ash are formed as by-products and the hot air and $CO_2$ gas are diverted out of the top of the vessel 36. The process and system of the present invention provides for further process flexibility by allowing the syn-coal 62 to be withdrawn from the third reaction zone 26 for direct use or diverted to a syn-coal conglomeration unit 108 for producing lump coke 120 to be used in steel blast furnace operations.

In describing the invention, reference has been made to a preferred embodiment and illustrative advantages of the invention. Those skilled in the art, however, and familiar with the instant disclosure of the subject invention, may recognize additions, deletions, modifications, substitutions and other changes which fall within the purview of the subject invention.

What is claimed:

1. A solid gasification system for the production of a medium grade BTU gas comprising:

a gas reaction vessel which contains a first, second, third, and fourth reaction zone;

a first inlet means for receiving and directing a blended mixture of a solid carbonaceous fuel and a catalyst reagent to said first reaction zone of said reaction vessel;

a second inlet means for receiving and directing heated air to said first reaction zone of said reaction vessel;

a third inlet means for receiving and directing steam to said second reaction zone of said gasification reaction vessel;

a gas product outlet means for removing a medium grade BTU gas from the gasification reaction vessel;

a conveyance means for delivering a blended mixture of a solid fuel and catalyst reagent through said first inlet means;

whereby the hot air delivered to said first reaction zone through said second inlet means reacts with the carbon of the solid fuel in an exothermic reaction for the production of a low grade BTU gas and the steam delivered to said second reaction zone through said third inlet means reacts with carbon deposited on said catalyst reagent in an endothermic reaction for the production of a high grade BTU gas wherein the low BTU gas and the high grade BTU gas mix in the third reaction zone thereby forming a medium grade BTU gas.

2. A solid gasification system as defined in claim 1 further comprising a first and second outlet means for removing a synthetic coal product from the third reaction zone of the gasification reaction vessel such that the synthetic coal is removed from the third reaction zone through said first outlet means as a clean by-product having direct commercial use and the synthetic coal is removed from the third reaction zone through said second outlet means for recycling back into the gasification reaction vessel.

3. A solid gasification system as defined in claim 2 further comprising a synthetic coal heating vessel having an inlet means for receiving withdrawn synthetic coal from said second outlet means of said gasification reaction vessel and an air inlet means for receiving compressed air such that the air and the carbon deposited on the recycled synthetic coal react in an exothermic reaction to produce additional reaction heat, said synthetic coal heating vessel further comprising an outlet means for removing hot recycled synthetic coal from the heating vessel for delivery to a fourth inlet means of said gasification vessel which receives and directs the hot synthetic coal to the first reaction zone.

4. A solid gasification system as defined in claim 3 wherein the synthetic coal heating vessel further comprises an upper outlet means for removing contaminant product gases from the heating vessel.

5. A solid gasification system as defined in claim 1 further comprising a fifth inlet means for receiving and directing lime (CaO) into said fourth reaction zone whereby the lime reacts with a contaminant sulfur gas ($H_2S$) to produce a clean calcium sulfide (CaS) product.

6. A solid gasification system as defined in claim 5 further comprising a third outlet means for removing the calcium sulfide (CaS) product from the fourth reaction zone for delivery to a storage facility and a fourth outlet means for removing a limestone ($CaCO_3$) by-product from the fourth reaction zone for delivery to a further system reaction vessel.

7. A solid gasification system as defined in claim 1 further comprising a hot air production vessel having an inlet for receiving a limestone ($CaCO_3$) by-product from the fourth reaction zone of the gasification vessel and a synthetic coal inlet for receiving synthetic coal removed from the third reaction zone of the gasification vessel and an air inlet means for receiving compressed air whereby the carbon of the synthetic coal reacts with the air in an exothermic reaction to create a hot $CO_2$ and air gas product which is then diverted out an outlet of the hot air production vessel for delivery to the first reaction zone of the gasification reaction vessel.

8. A solid gasification system as defined in claim 7 wherein the hot air production vessel further comprises a lime outlet means for removing lime (CaO) as a reaction by-product from the vessel for delivery to the fourth reaction zone of the gasification reaction vessel.

9. A solid gasification system as defined in claim 7 wherein the hot air production vessel further comprises an outlet means for removing an ash by-product of the air gasification of the synthetic coal.

10. A solid gasification system as defined in claim 1 wherein the first and second reaction zones are located in a lower portion of the gasification reaction vessel, the fourth reaction zone is located at an upper portion of the gasification reaction vessel, and the third reaction zone is located therebetween.

11. A solid gasification system as defined in claim 10 wherein a process partition separates the third and fourth reaction zones.

12. A solid gasification system as defined in claim 10 wherein a sleeve separates the first and second reaction zone such that the first reaction zone is contained within the sleeve and the second reaction zone is contained in a circumferential volume bound by the gasification reaction vessel wall and the sleeve.

13. A solid gasification system as defined in claim 12 wherein the gasification vessel is cylindrical in form and the sleeve is cylindrical in form thereby creating an annular second reaction zone.

14. A solid gasification systems as defined in claim 13 wherein the third steam inlet means of the gasification vessel consists of a plurality of inlets peripherally spaced about the gasification vessel.

15. A solid gasification system as defined in claim 1 further comprising an outlet means located at a lower portion of the gasification vessel for removing reaction reagent for recycling.

16. A solid gasification system as defined in claim 1 wherein said conveying means is a variable speed screw drive.

17. A solid gasification system as defined in claim 1 further comprising an outlet means located at a lower most portion of the gasification vessel for removing contaminant metal by-products for delivery to a safe storage facility.

18. A solid gasification system as defined in claim 1 further comprising an inlet means located at a lower portion of the gasification vessel for receiving $CO_2$ gas.

19. A solid gasification system as defined in claim 1 further comprising a synthetic coal conglomeration unit comprising a vessel having an inlet means for receiving a synthetic coal by-product delivered from the third reaction zone of the gasification vessel and an air inlet means for receiving compressed air such that the carbon of the synthetic coal reacts with the air to create a sufficient amount of heat to melt a portion of the ash of the synthetic coal to conglomerate the synthetic coal thereby creating lump coke, and further comprising an outlet means for removing the lump coke.

20. A solid gasification system as defined in claim 19 wherein the synthetic coal conglomeration unit comprises at least a pair of lock bins that receive the lump coke from the outlet means of the conglomeration vessel such that heavier lump coke is withdrawn from a lower portion of the vessel.

* * * * *